US005476267A

United States Patent [19]

Gertsikov

[11] Patent Number: 5,476,267

[45] Date of Patent: Dec. 19, 1995

[54] WEIGHTED HEMI-SPHERICAL TOY

[76] Inventor: Daniel Gertsikov, 310 Arballo Dr., Apt. 1L, San Francisco, Calif. 94132

[21] Appl. No.: 433,984

[22] Filed: May 4, 1995

[51] Int. Cl.[6] ..... A63B 67/18

[52] U.S. Cl. ..... 273/417; 273/428

[58] Field of Search ..... 273/428, 417, 273/424; D21/168, 170; 446/268, 385

[56] References Cited

U.S. PATENT DOCUMENTS

| | | | |
|---|---|---|---|
| D. 233,450 | 10/1974 | McLachlan et al. | D21/168 |
| D. 355,941 | 2/1995 | Johnson | D21/170 X |
| 3,099,450 | 7/1963 | Randall | 273/424 |
| 3,368,815 | 2/1968 | Alabastro | 273/417 |
| 3,759,518 | 9/1973 | Mroz | 273/417 |
| 3,834,705 | 9/1974 | Wong | 273/417 |
| 3,901,509 | 8/1975 | Liong | 273/417 |
| 4,019,738 | 4/1977 | Tong | 273/417 |
| 4,082,281 | 4/1978 | Chen | 273/417 |
| 4,133,533 | 1/1979 | Doyle | 273/417 |
| 4,756,529 | 7/1988 | Stillinger | 446/268 X |

*Primary Examiner*—Paul E. Shapiro

[57] ABSTRACT

A toy for receiving impact from a human foot to entertain and exercise an individual. The inventive device includes a circular base web having a hemi-spherical volume of fibers extending therefrom. A circular weight is secured to a center of the base web and causes the toy to assume a desired orientation when falling through the air subsequent to being impacted.

4 Claims, 4 Drawing Sheets

FIG 3
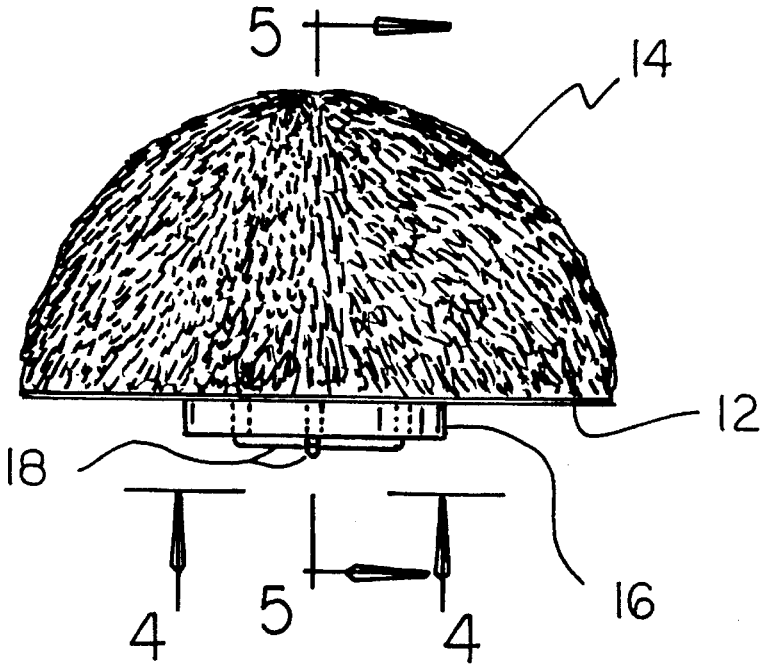
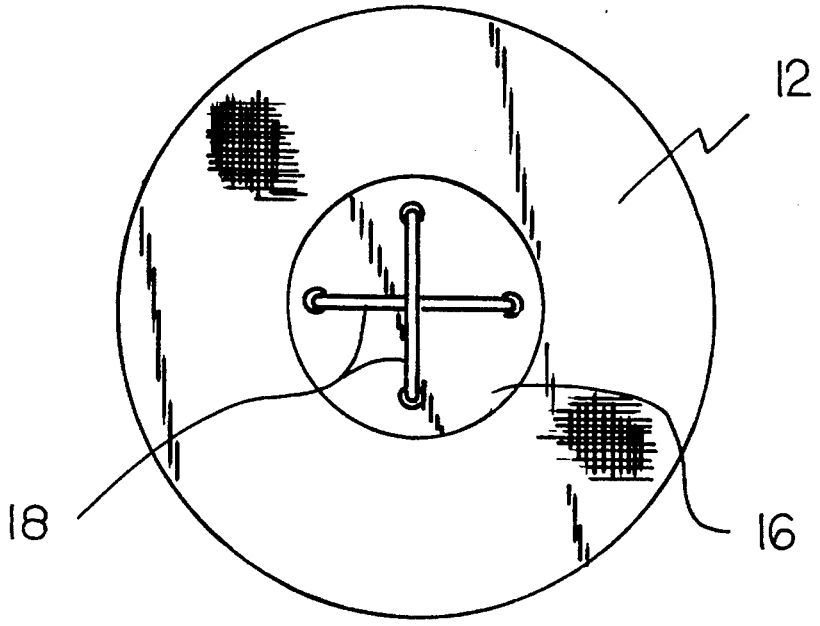
FIG 4

FIG 5
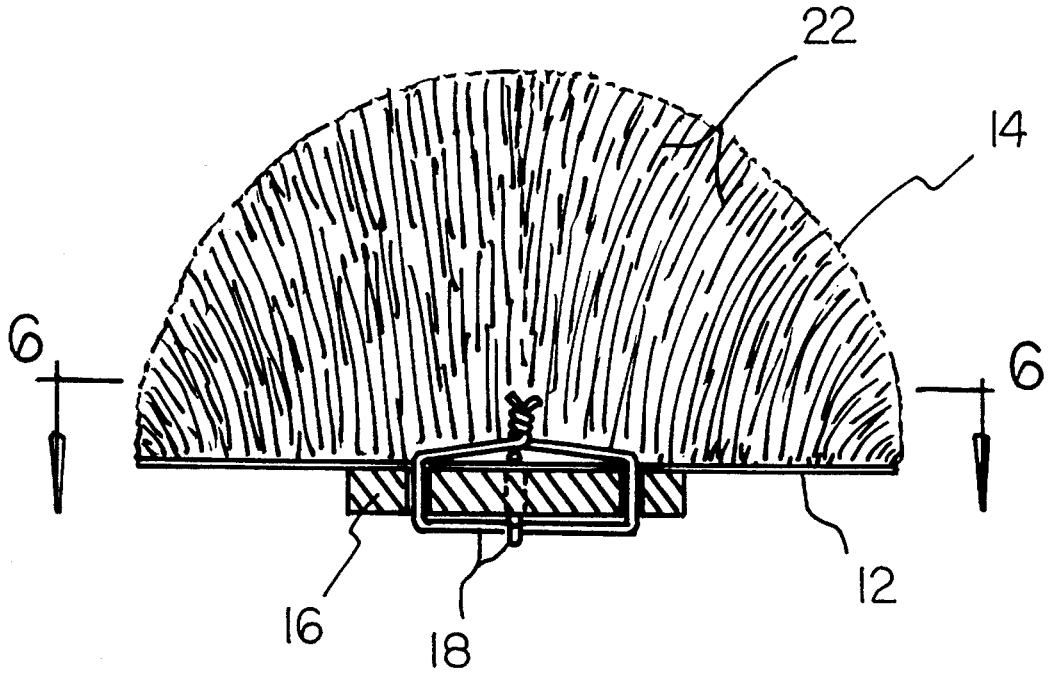
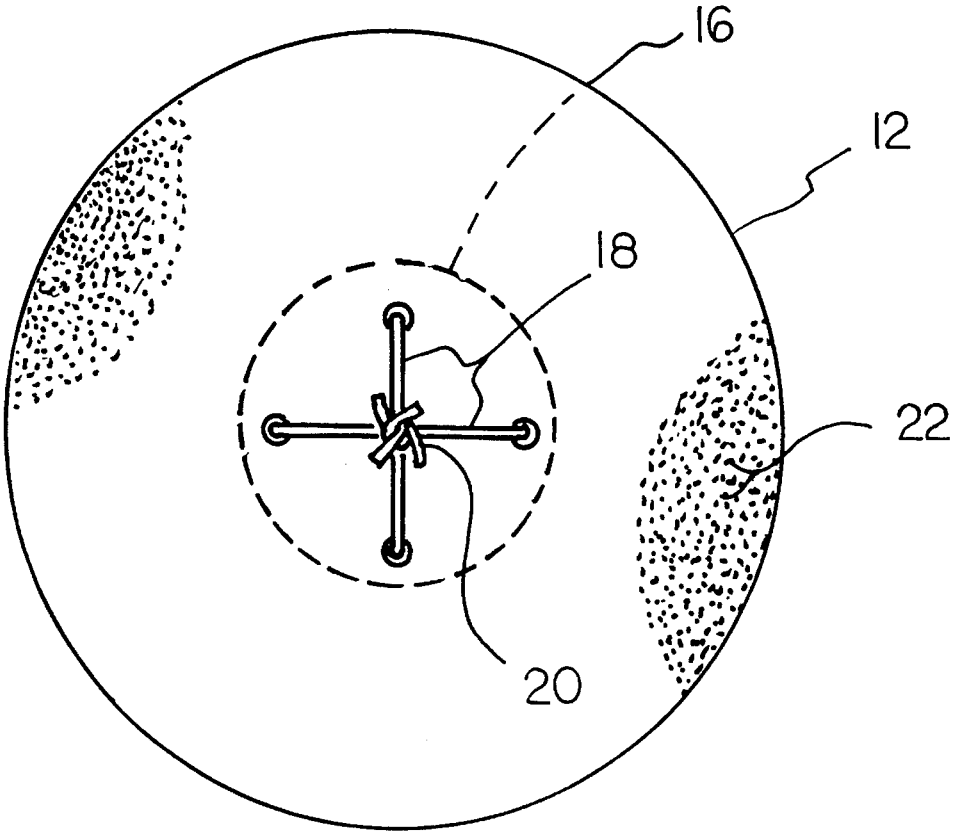
FIG 6

WEIGHTED HEMI-SPHERICAL TOY

BACKGROUND OF THE INVENTION

1. Field of the Invention

The present invention relates to toy structures and more particularly pertains to an weighted hemi-spherical toy for receiving impact from a human foot to entertain and exercise an individual.

2. Description of the Prior Art

The use of toy structures is known in the prior art. More specifically, toy structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art toy structures include U.S. Pat. No. 4,429,487; U.S. Pat. No. 3,759,518; U.S. Pat. No. Des. 314,598; U.S. Pat. No. Des. 305,788; U.S. Pat. No. Des. 273,504; and U.S. Pat. No. Des. 274,070.

While these devices fulfill their respective, particular objectives and requirements, the aforementioned patents do not disclose a weighted hemi-spherical toy for receiving impact from a human foot to entertain and exercise an individual which includes a circular base web having a hemi-spherical volume of fibers extending therefrom, and a circular weight secured to a center of the base web for causing the toy to assume a desired orientation when falling through the air subsequent to being impacted.

In these respects, the weighted hemi-spherical toy according to the present invention substantially departs from the conventional concepts and designs of the prior art, and in so doing provides an apparatus primarily developed for the purpose of receiving impact from a human foot to entertain and exercise an individual.

SUMMARY OF THE INVENTION

In view of the foregoing disadvantages inherent in the known types of toy structures now present in the prior art, the present invention provides a new weighted hemi-spherical toy construction wherein the same can be utilized for entertaining and exercising an individual. As such, the general purpose of the present invention, which will be described subsequently in greater detail, is to provide a new weighted hemi-spherical toy apparatus and method which has many of the advantages of the toy structures mentioned heretofore and many novel features that result in a weighted hemi-spherical toy which is not anticipated, rendered obvious, suggested, or even implied by any of the prior art toy structures, either alone or in any combination thereof.

To attain this, the present invention generally comprises a toy for receiving impact from a human foot to entertain and exercise an individual. The inventive device includes a circular base web having a hemi-spherical volume of fibers extending therefrom. A circular weight is secured to a center of the base web and causes the toy to assume a desired orientation when falling through the air subsequent to being impacted.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new weighted hemi-spherical toy apparatus and method which has many of the advantages of the toy structures mentioned heretofore and many novel features that result in a weighted hemi-spherical toy which is not anticipated, rendered obvious, suggested, or even implied by any of the prior art toy structures, either alone or in any combination thereof.

It is another object of the present invention to provide a new weighted hemi-spherical toy which may be easily and efficiently manufactured and marketed.

It is a further object of the present invention to provide a new weighted hemi-spherical toy which is of a durable and reliable construction.

An even further object of the present invention is to provide a new weighted hemi-spherical toy which is susceptible of a low cost of manufacture with regard to both materials and labor, and which accordingly is then susceptible of low prices of sale to the consuming public, thereby making such weighted hemi-spherical toys economically available to the buying public.

Still yet another object of the present invention is to provide a new weighted hemi-spherical toy which provides in the apparatuses and methods of the prior art some of the advantages thereof, while simultaneously overcoming some of the disadvantages normally associated therewith.

Still another object of the present invention is to provide a new weighted hemi-spherical toy for receiving impact from a human foot to entertain and exercise an individual.

Yet another object of the present invention is to provide a new weighted hemi-spherical toy which includes a circular base web having a hemi-spherical volume of fibers extending therefrom, and a circular weight secured to a center of the base web for causing the toy to assume a desired orientation when falling through the air subsequent to being impacted.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood when consideration is given to the following detailed description thereof. Such description makes reference to the annexed drawings wherein:

FIG. 3 is a side elevation view thereof.

FIG. 4 is a bottom plan view of the present invention taken from line 4—4 of FIG. 3.

FIG. 5 is a cross sectional view taken along line 5—5 of FIG. 3.

FIG. 6 is a cross sectional view taken along line 6—6 of FIG. 5.

DESCRIPTION OF THE PREFERRED EMBODIMENT

Figure 1:
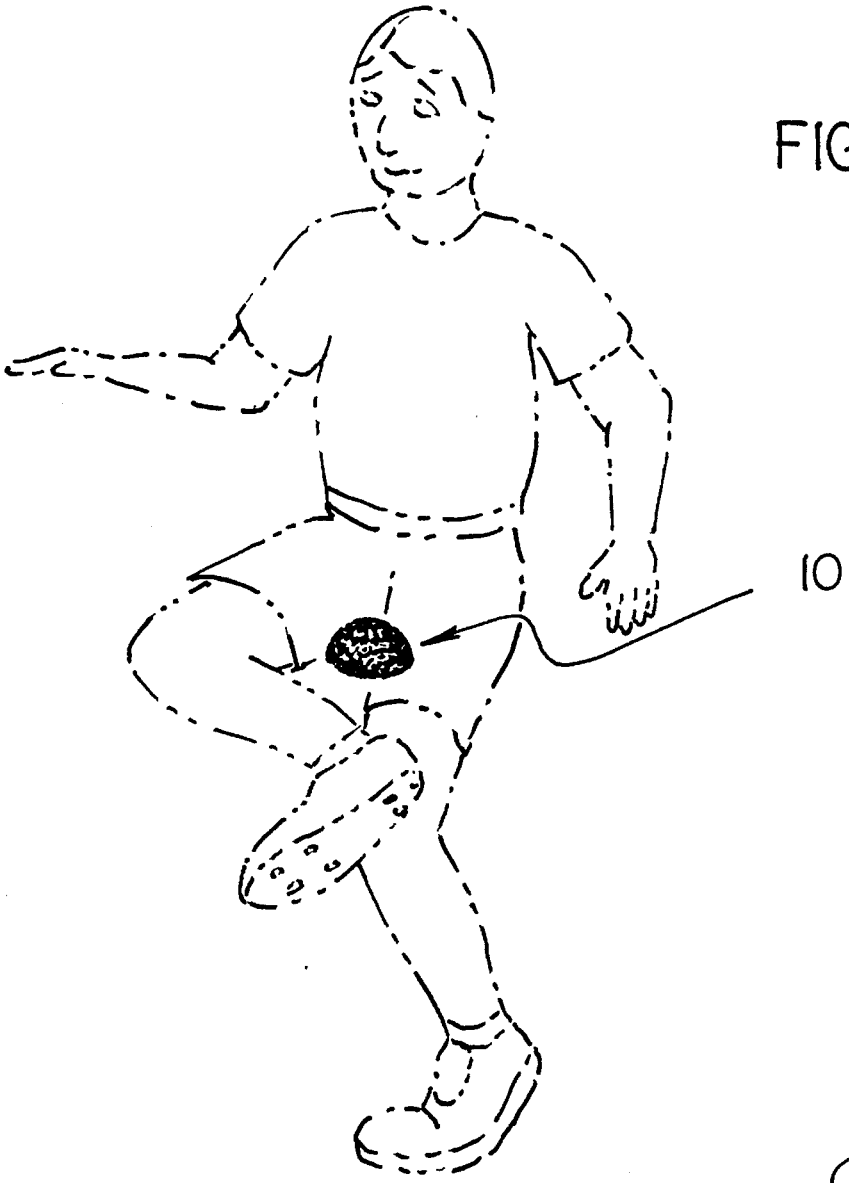
FIG. 1 is an isometric illustration of a weighted hemi-spherical toy according to the present invention in use.

With reference now to the drawings, and in particular to FIGS. 1–7 thereof, a new weighted hemi-spherical toy embodying the principles and concepts of the present invention and generally designated by the reference numeral 10 will be described.

Figure 2:
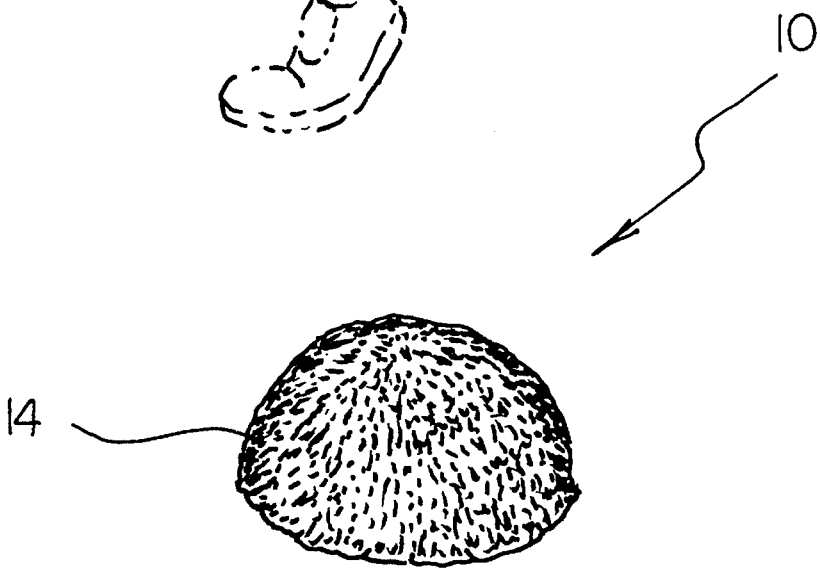
FIG. 2 is an isometric illustration of the present invention, per se.
Figure 7:
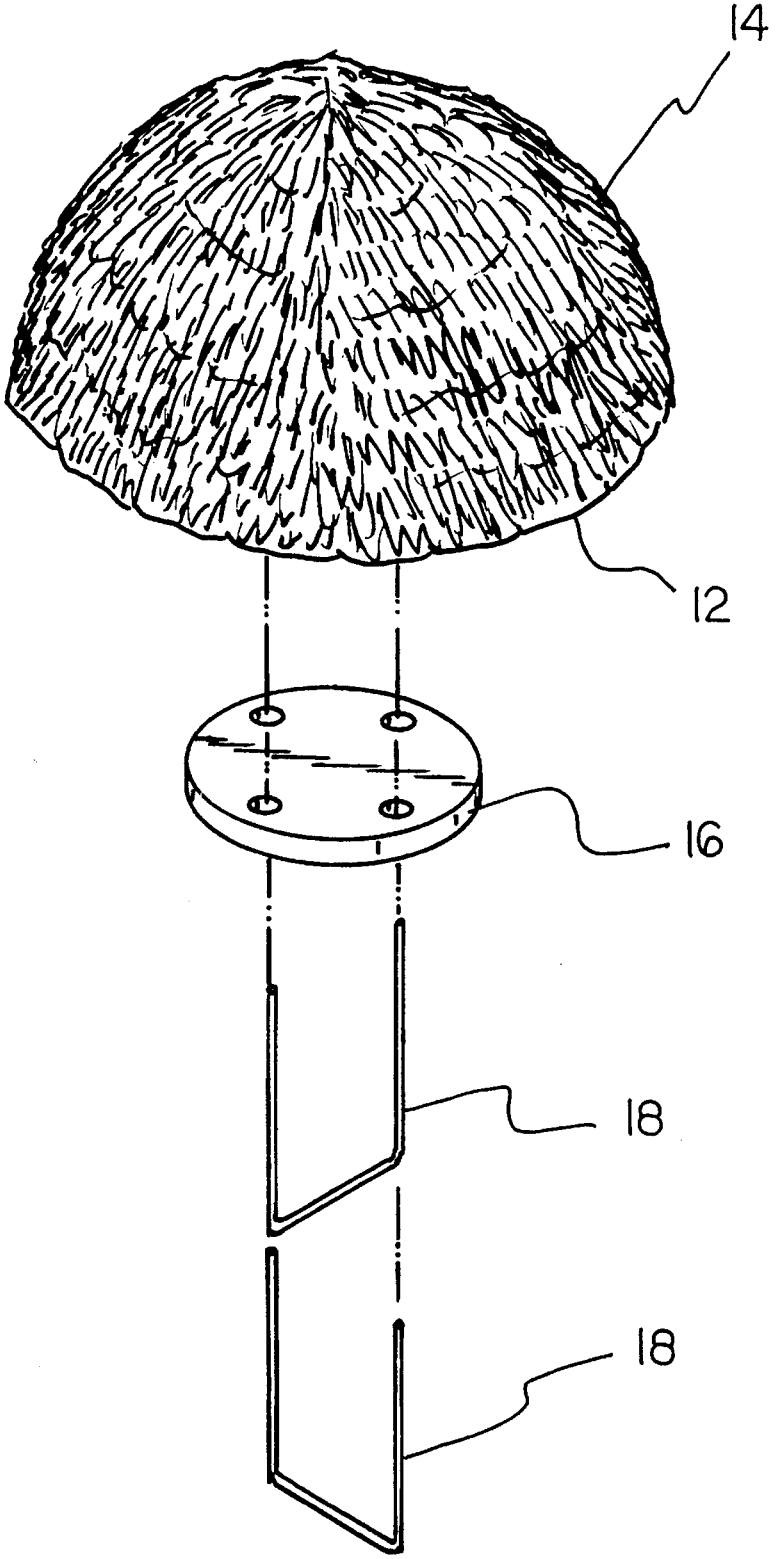
FIG. 7 is an exploded isometric illustration of the present invention.

More specifically, it will be noted that the weighted hemi-spherical toy 10 comprises a substantially circular base web 12 having a hemi-spherical volume of fibers 14 extending from a first side thereof, as shown in FIGS. 1 through 3 of the drawings. A circular weight member 16 is secured to a second side of the base web 12 and is preferably centered relative to the base web, as shown in FIGS. 3 through 6 of the drawings. By this structure, an individual can kick or otherwise impact the toy 10, as shown in FIG. 1, whereby the circular weight member 16 functions as a leading edge with the hemi-spherical volume of fibers 14 functioning as a trailing edge of the toy during falling of the toy towards a ground surface such that impact from a individual is received by the toy on the circular weight member 16.

As best illustrated in FIGS. 3 through 7, it can be shown that the circular weight member 16 is shaped so as to define a plurality of apertures directed therethrough permitting securement of the weight member to the base web 12. To this end, the circular weight member 16 is shaped so as to define spaced pairs of mounting apertures directed therethrough which are oriented at orthogonal angles relative to one another. A pair of securing wires 18 are each directed through an individual one of the pairs of mounting apertures of the circular weight member 16 and through the circular base web 12. As shown in FIG. 6, the securing wires 18 are joined together at a twisted juncture 20 so as to secure the circular weight member 16 to the base web 12. By this structure, ease of assembly of the device 10 is provided, with an end user having an option of selectively removing the securing wires 18 and substituting a substantially similarly constructed circular weight member 16 of heavier weight in place of an existing circular weight member.

As best illustrated in FIGS. 5 and 6 of the drawings, it can be shown that the hemi-spherical volume of fibers 14 comprises a plurality of individual fibers 22 which are each secured to the base web 12 and projects substantially orthogonally therefrom. The plurality of individual fibers 22 each vary in height relative to a distance from a center of the base web 12. In other words, the individual fibers 22 located proximal to a center of the base web 12 are substantially longer in length than the individual fibers 22 located proximal to an outer periphery of the base web 12 so as to define the substantially hemi-spherical shape of the volume of fibers 14.

Preferably, the circular weight member 16 is of a first diameter, with the base web 12 being of a second diameter, wherein the second diameter is substantially greater than the first diameter as shown in the drawings. Such configuration of the circular weight member 16 relative to the base web 12 permits an annular portion of the base web 12 to project radially beyond the circular weight member 16 such that free articulation of an annular volume of the hemi-spherical volume of fibers 14 is permitted to articulate relative to the circular weight member 16 to impart aerodynamic stability to the device 10 during falling thereof towards a ground surface.

In use, the weighted hemi-spherical toy 10 according to the present invention can be easily utilized to exercise and entertain an individual. To this end, an individual can simply repeatedly kick the circular weight member 16 as shown in illustration of FIG. 1 to effect repeated oscillations of the device 10 against a force of gravity.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A weighted hemi-spherical toy comprising:

a substantially circular base web having a hemi-spherical volume of fibers extending from a first side thereof;

a circular weight member secured to a second side of the base web and being centered relative to the base web.

2. The weighted hemi-spherical toy of claim 1, wherein the circular weight member is shaped so as to define a plurality of apertures directed therethrough; and further comprising securing wires directed through the mounting apertures of the circular weight member and through the circular base web, the securing wires being joined together at a twisted juncture so as to secure the circular weight member to the base web.

3. The weighted hemi-spherical toy of claim 2, wherein the hemi-spherical volume of fibers comprises a plurality of individual fibers which are each secured to the base web and project substantially orthogonally therefrom, the plurality of individual fibers each varying in height relative to a distance from a center of the base web such that the individual fibers located proximal to a center of the base web are substantially longer in length than the individual fibers located proximal to an outer periphery of the base web to define the substantially hemi-spherical shape of the volume of fibers.

4. The weighted hemi-spherical toy of claim 3, wherein the circular weight member is of a first diameter, with the base web being of a second diameter, wherein the second diameter is substantially greater than the first diameter such that an annular portion of the base web projects radially beyond the circular weight member.

* * * * *